US010023927B2

(12) United States Patent
Sikora et al.

(10) Patent No.: US 10,023,927 B2
(45) Date of Patent: Jul. 17, 2018

(54) HARDENING TOOL AND METHOD FOR PRODUCING HARDENED PROFILED SHAPED ARTICLES

(71) Applicants: ThyssenKrupp Steel Europe AG, Duisburg (DE); ThyssenKrupp AG, Essen (DE)

(72) Inventors: Sascha Sikora, Lunen (DE); Jorg Gorschlüter, Hamm (DE); Thomas Flehmig, Ratingen (DE)

(73) Assignees: ThyssenKrupp Steel Europe AG, Duisburg (DE); ThyssenKrupp AG, Essen (DE)

( * ) Notice: Subject to any disclaimer, the term of this patent is extended or adjusted under 35 U.S.C. 154(b) by 200 days.

(21) Appl. No.: 14/790,406

(22) Filed: Jul. 2, 2015

(65) Prior Publication Data

US 2016/0010167 A1 Jan. 14, 2016

(30) Foreign Application Priority Data

Jul. 8, 2014 (DE) ..... 10 2014 109 553

(51) Int. Cl.

| | |
|---|---|
| ***C21D 9/46*** | (2006.01) |
| ***C21D 1/673*** | (2006.01) |
| ***B21D 37/16*** | (2006.01) |

(52) U.S. Cl.

CPC ..... *C21D 1/673* (2013.01); *B21D 37/16* (2013.01); *C21D 9/46* (2013.01)

(58) Field of Classification Search

CPC ..... C21D 1/673; C21D 9/46
USPC ..... 148/651
See application file for complete search history.

(56) References Cited

U.S. PATENT DOCUMENTS

2007/0271978 A1* 11/2007 Brandstatter ..... C21D 1/673 72/47
2011/0232354 A1 9/2011 Hielscher et al.

FOREIGN PATENT DOCUMENTS

| | | | |
|---|---|---|---|
| CN | 102198465 | A | 9/2011 |
| CN | 103056212 | A | 4/2013 |
| DE | 102009043926 | A1 | 3/2011 |
| DE | 102011108912 | A1 | 1/2013 |
| JP | 2005169394 | A | 6/2005 |
| JP | 2007075834 | A | 3/2007 |

* cited by examiner

*Primary Examiner* — Brian Walck
(74) *Attorney, Agent, or Firm* — The Webb Law Firm

(57) ABSTRACT

A hardening tool is disclosed for producing hardened profiled shaped articles from a sheet steel material, which hardening tool has at least two tool parts which are movable relative to one another and between which a heated sheet steel material which has been preformed into a profiled shaped article and is optionally finally formed and is cooled in a hardening process, wherein the hardening tool has a mold core which, during the hardening process, is arranged in a recess of the profiled shaped article, and wherein the mold core has at least one outlet opening for the pressurization of cooling medium from a cooling medium duct on the profiled shaped article.

5 Claims, 1 Drawing Sheet

HARDENING TOOL AND METHOD FOR PRODUCING HARDENED PROFILED SHAPED ARTICLES

CROSS-REFERENCE TO RELATED APPLICATION

This application claims priority to German Patent Application No. 102014109553.7 filed Jul. 8, 2014, the disclosure of which is hereby incorporated in its entirety by reference.

BACKGROUND OF THE INVENTION

Field of the Invention

The present invention relates to a hardening tool.

Description of Related Art

Such press hardening tools are typically used for the production of hardened sheet-metal shaped articles composed of sheet steel material, for example for the production of motor vehicle parts, and are well known from the prior art, for example from documents DE 10 2011 108 912 A1 and DE 10 2009 043 926 A1.

Normally, in this case, a heated sheet steel material as starting material is arranged between tool parts of the press hardening tool, and subsequently, by virtue of the tool parts being moved together, a shaped article is formed from the sheet steel material. After the shaped article has been shaped and pressed, the shaped article is cooled beyond the critical cooling rate of the material, in order to harden the shaped article. During the production of shaped articles in the form of open and closed profiles, hereinafter also referred to as profiled shaped articles, it is generally the case in the hardening tool that heat-dissipating contact is realized only on one side. It is conceivable, the case of profiled shaped articles, to use an internal tool core which, by way of contact, permits a faster dissipation of the heat in the hardening process. Profiled shaped articles with relatively complex component geometries may have undercut regions, such that the mould core cannot abut fully and in all regions against the internal surfaces of the profiled shaped article. The undercut of the component would have the effect that the mould core does not cover all regions or can no longer be removed from the profiled component. It is thus disadvantageously the case that profiled shaped articles with relatively complex component geometries cannot be fully hardened, or can be hardened only with relatively long hardening times.

SUMMARY OF THE INVENTION

It is an object of the present invention, in the production of profiled shaped articles, to ensure adequate hardening with short cycle times, even if the profiled shaped articles have a relatively complex component geometry.

Said object is achieved by means of a hardening tool for producing hardened profiled shaped articles from a sheet steel material, having at least two tool parts which are movable relative to one another and between which a previously in particular cold-formed and subsequently heated profiled shaped article is cooled in a hardening process, wherein the hardening tool has a mould core which, during the hardening process, is arranged in a recess of the profiled shaped article, and wherein the mould core has at least one outlet opening for the pressurization of cooling medium from a cooling medium duct on the profiled shaped article.

The hardening tool according to the invention has the advantage over the prior art inter alia that the mould core has a cooling medium outlet, whereby, in regions in which the profiled component, owing to its complex geometry, does not abut areal against the tool part or against the mould core, the profile component is cooled by the cooling medium emerging from the outlet opening. In particular, the cooling medium passes into any cavities between the profiled component and the tool parts or between the profiled component and the mould core. It is ensured in this way that the profiled component is cooled at the corresponding rate, and thus hardened, in all of its regions. Furthermore, the cycle times can be shortened by way of an acceleration of the cooling process, whereby the production of profiled components using the hardening tool according to the invention is made less expensive. In particular, the cooling medium comprises a cooling fluid, in particular in the form of cooling water. The mould core may be formed either independently of the two tool parts or as an integral constituent part of one of the two tool parts. The profiled shaped article to be produced may for example be a beam component for a motor vehicle, in particular a body component. A final step of shaping and/or calibration of the hot profiled shaped article may also be performed in the hardening tool before and/or during the hardening process.

Advantageous embodiments and refinements of the invention will emerge from the subclaims and from the description with reference to the drawings.

In a preferred embodiment of the present invention, it is provided that the at least one outlet opening faces toward the profiled shaped article such that the profiled shaped article is pressurized directly by the cooling medium emerging from the outlet opening. It is conceivable that the cooling medium emerging from the outlet opening pressurizes directly on the profiled shaped article after emerging.

In a preferred embodiment of the present invention, it is provided that the mould core has a multiplicity of outlet openings which interact with the cooling medium duct. The cooling medium can thus pass at multiple locations from the cooling medium duct into the cavities between the profiled component and the tool parts or between the profiled component and the mould core, whereby rapid cooling of the profile component is made possible or ensured.

In a further preferred embodiment of the present invention, it is provided that the mould core has a cooling medium duct with a closed cross section or with a cross section which is open on one side. The cooling medium duct with a cross section which is open on one side is in particular in the form of a groove and can thus be implemented in a relatively inexpensive and straightforward manner. The cooling duct is however preferably formed with a closed cross section, that is to say as a passage bore.

In a further preferred embodiment of the present invention, it is provided that the two tool parts are movable relative to one another along a working direction, wherein the mould core and/or the parts thereof is/are movable relative to the two tool parts along a further working direction which is at an angle, and in particular at right angles, with respect to the working direction. It is thus advantageously possible for profiled shaped articles with relatively complex component geometries, such as for example undercuts, to be realized. The two tool parts and the mould core are in particular each designed such that the sheet steel material abuts at least partially areal against tool active surfaces of the respective tool parts or of the mould core. In this way, it is sought to realize good dissipation of heat. Those regions of the profiled shaped article which do not abut areal against the tool active surfaces of the two tool parts or of the mould core are cooled by the cooling medium. Furthermore, the mould core may have means which permit expansion of the core, whereby improved contact between the mould core and the profiled shaped article, and an associated more effective dissipation of heat, can be ensured. The mould core may for example be in the form of an expanding core. A further advantage of the mould core is its capability to be expanded by way of slide elements, whereby firstly, the required action is attained even in regions which have an undercut and which require support, and secondly, the withdrawal of the mould core out of the recess of the profiled shaped article is facilitated, as the cross section of the profiled shaped article is reduced in size as a result of the cooling.

In a further preferred embodiment of the present invention, it is provided that the mould core has a further cooling medium duct for a further cooling medium, wherein the further cooling medium duct is designed such that the further cooling medium circulates, in the region of the profiled shaped article, only within the mould core. The further cooling medium duct may advantageously be used for cooling the mould core. In this case, the further cooling medium duct is in particular formed independently of the cooling medium duct, and furthermore has no outlet openings for the further cooling medium in the region of the profiled shaped article.

It is conceivable for the hardening tool to have a multiplicity of such further cooling medium ducts, also in the region of the tool parts.

In a further preferred embodiment of the present invention, it is provided that at least one of the two tool parts and/or the mould core has a ventilation means, in particular a ventilation duct. By way of the ventilation means, it is advantageously possible for air which is present in the cavity between the profiled component and the tool parts or between the profiled component and the mould core to escape when the cooling medium is introduced into the cavity.

The present invention also relates to a method for producing hardened profiled shaped articles from a sheet steel material, in particular by way of a hardening tool according to one of the preceding claims, wherein, in a first method step, a sheet steel material is in particular cold-formed to form an open or closed profiled shaped article, and wherein, in a second method step, the shaped profiled shaped article is heated and is hardened by cooling, wherein, in the second method step, a mould core is arranged in a recess of the profiled shaped article, and the profiled shaped article is pressurized with a cooling medium which is conducted to the profiled shaped article from a cooling medium duct of the mould core through at least one outlet opening formed on the tool core.

The method according to the invention, analogously to the hardening tool according to the invention, has the advantage over the prior art that even profiled shaped articles with relatively complex component geometries can be rapidly cooled and thus hardened because, in the second method step, the profiled shaped article is at least regionally also pressurized with a coolant in the form of the cooling medium.

It can be ensured in this way that all regions of the profiled shaped article are hardened, and/or that rapid cooling of all regions of the profiled shaped article is realized. Here, the cooling medium is in particular introduced into regions in which there is a cavity between the profiled component and the tool parts or between the profiled component and the mould core.

In one preferred embodiment of the present invention, it is provided that, before the second method step, the profiled shaped article is arranged between the two tool parts, the two tool parts are moved toward one another relative to one another along a working direction, and the mould core is moved into the recess along a further working direction which is at an angle, and in particular at right angles, with respect to the working direction.

In a further preferred embodiment of the present invention, it is provided that, before or during the second method step, the mould core is moved partially out of the recess, in particular before cooling medium is conveyed through the cooling medium duct. It is conceivable that, as a result of the mould core being moved partially out, a cavity is generated in targeted fashion between the profiled component and the mould core, into which cavity the cooling medium is introduced.

In a further preferred embodiment of the present invention, it is provided that, in the second method step, the mould core is cooled by means of a further cooling medium. The mould core is cooled in this way.

Further details, features and advantages of the invention will emerge from the drawings and from the following description of preferred embodiments on the basis of the drawings. Here, the drawings illustrate merely exemplary embodiments of the invention, which do not restrict the basic concept of the invention.

DESCRIPTION OF THE INVENTION

Identical parts are always denoted by the same reference signs in the various figures, and will therefore generally also each be referred to or mentioned only once.

Figure 1:
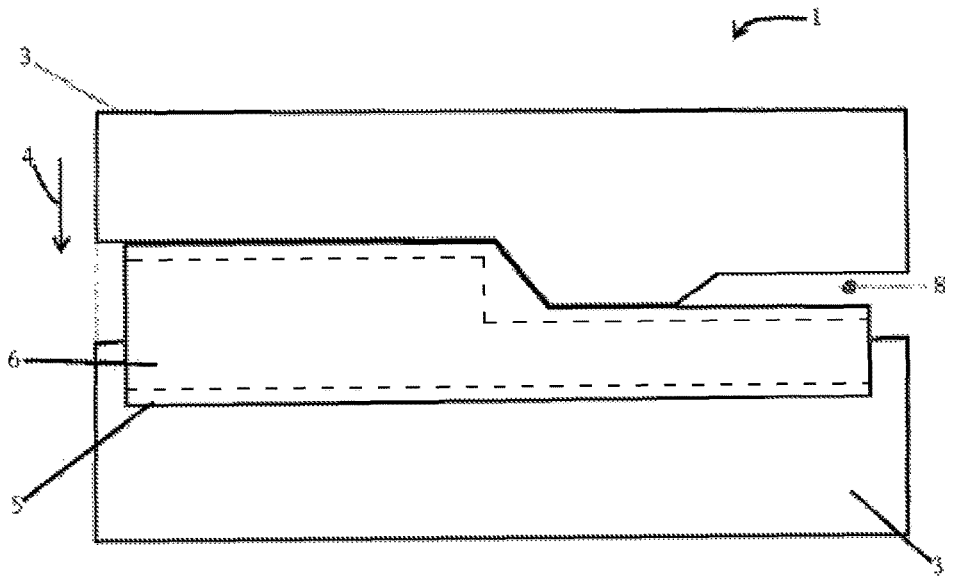
FIG. 1 shows a schematic side view of a hardening tool according to an exemplary embodiment of the present invention.

FIG. 1 shows a schematic side view of a hardening tool 1 for producing hardened profiled shaped articles 5 from a sheet steel material as per an exemplary embodiment of the present invention. The hardening tool 1 has two tool parts 3 which are movable relative to one another along a working direction 4. The previously in particular cold-formed and subsequently heated profiled shaped article 5 is firstly placed into the hardening tool 1 between the two tool parts 3. Subsequently, the two tool parts 3 are moved toward one another and receive the shaped sheet steel material in the recesses thereof.

Here, the lower tool part 3 has a mould core 6 which is arranged in a recess in the profiled shaped article 5. After the tool parts 3 have been moved together, the profiled shaped article 5 is cooled. The hot profiled shaped article 5 may be subjected to final shaping and/or to calibration as a result of the tool parts 3 being moved together. The profiled shaped article 5 is preferably cooled more rapidly than the critical cooling rate of the sheet steel material, whereby the profiled shaped article 5 is hardened during the cooling process. For the dissipation of the heat of the profiled shaped article 5, the two tool parts 3 are water-cooled. For this purpose, the two tool parts 3 have internal further cooling medium ducts (not illustrated) through which cooling water circulates in order to cool the tool parts 3.

The component geometry or the profiling of the profiled shaped article 5 has the effect that not all of the surfaces of the profiled shaped article 5 abut with a form fit against a tool surface of the mould core 6, and instead cavities 8 are formed between the profiled shaped article 5 and the tool parts 3.

In order that the profiled shaped article 5 is rapidly cooled and hardened even in the region of said cavities 8, the mould core 6 is equipped with a cooling medium duct for a cooling medium, wherein the cooling medium duct interacts with a multiplicity of outlet openings 7 on the mould core 6. The cooling medium emerges through said outlet openings 7 and passes into the cavities 8, whereby the profiled shaped article 5 is cooled and hardened also in the region of the cavities 8. In order that the air situated in the cavities 8 can escape from the hardening tool 1 as a result of the introduction of the cooling medium, the mould core 6 comprises a ventilation means 2 in the form of a ventilation duct formed as a groove. The cooling medium comprises a cooling fluid, preferably in the form of cooling water.

Figure 2:
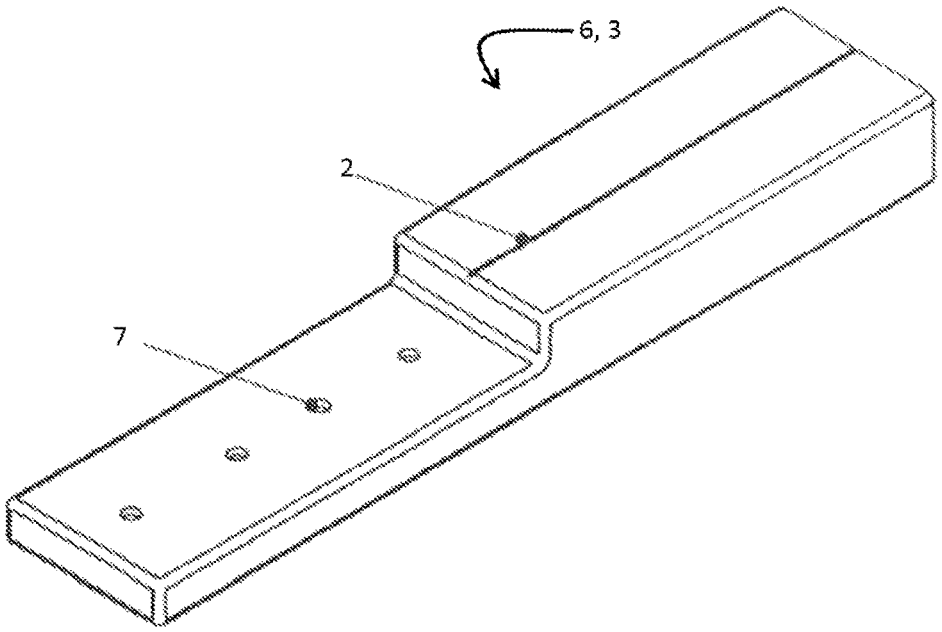
FIG. 2 shows a schematic perspective view of a mould core of a hardening tool according to an exemplary embodiment of the present invention.

FIG. 2 illustrates a schematic perspective view of a non-expandable mould core 6 of the hardening tool 1 illustrated in FIG. 1 as per an exemplary embodiment of the present invention. The mould core 6 has an inner cooling medium duct (not illustrated) and, for example, four outlet openings 7 which are fluidically connected to the cooling medium duct and through which the cooling medium flowing through the cooling medium duct emerges from the cooling medium duct and can pressurize the profiled shaped article 5 in order to cool the latter. Furthermore, the mould core 6 has the ventilation means 2 in the form of a groove.

LIST OF REFERENCE NUMERALS

1 Hardening tool
2 Ventilation means
3 Tool parts
4 Working direction
5 Profiled shaped article
6 Mould core
7 Outlet opening
8 Cavities

The invention claimed is:

1. A method for producing hardened profiled shaped articles from a sheet steel material by way of a hardening tool comprising, in a first method step, cold-forming a sheet steel material to form a profiled shaped article, and wherein, in a second method step, heating the profiled shaped article and hardening the profiled shaped article by cooling, wherein, in the second method step, a mould core is arranged in a recess of the profiled shaped article, wherein, in the second method step, the profiled shaped article is pressurized with a cooling medium which is conducted to the profiled shaped article from a cooling medium duct of the mould core through at least one outlet opening formed on the mould core, and wherein, before the second method step, the method comprises arranging the profiled shaped article between two tool parts of the hardening tool, moving the two tool parts toward one another relative to one another along a working direction, and moving the mould core into the recess along a further working direction which is at an angle with respect to the working direction.

2. The method according to claim 1, wherein, before or during the second method step, the mould core is moved partially out of the recess, before the cooling medium is conveyed through the cooling medium duct.

3. The method according to claim 1, wherein the cooling medium is introduced into a cavity between one of the two tool parts of the hardening tool and the profiled shaped article and/or into a cavity between the mould core and the profiled shaped article.

4. The method according to claim 1, wherein, in the second method step, the mould core is cooled by a further cooling medium duct.

5. The method according to claim 1, wherein the angle is a right angle.

* * * * *